US005462040A

United States Patent [19]

Krebs et al.

[11] Patent Number: 5,462,040

[45] Date of Patent: Oct. 31, 1995

[54] METHOD FOR DISTINGUISHING CAUSES OF ERROR IN THE MIXTURE FORMING OR MIXTURE REGULATING SYSTEM OF AN INTERNAL COMBUSTION ENGINE

[75] Inventors: Stefan Krebs, Regensburg; Ludwig Kettl, Aiterhofen; Wojciech Cianciara, Gruenthal, all of Germany

[73] Assignee: Siemens Aktiengesellschaft, Munich, Germany

[21] Appl. No.: 243,328

[22] Filed: May 16, 1994

[30] Foreign Application Priority Data

May 14, 1993 [EP] European Pat. Off. ..... 93107898

[51] Int. Cl.[6] ..... F02D 41/14; F02D 41/22

[52] U.S. Cl. ..... 123/688; 123/690

[58] Field of Search ..... 123/479, 688, 123/690, 697; 73/23.32; 204/401

[56] References Cited

U.S. PATENT DOCUMENTS 5,054,452 10/1991 Denz ..... 123/688 X
5,209,206 5/1993 Danno et al. ..... 123/688 X

FOREIGN PATENT DOCUMENTS 2219093 11/1989 United Kingdom .

OTHER PUBLICATIONS

Patent Abstract of Japan, vol. 16434, Sep. 10, 1992; snf JP–A–4148038 (Honda) May 21, 1992.

*Primary Examiner*—Tony M. Argenbright

*Attorney, Agent, or Firm*—Herbert L. Lerner; Laurence A. Greenberg

[57] ABSTRACT

A method for distinguishing sources of error in a mixture formation or mixture regulating system of an internal combustion engine having an exhaust system with a lambda regulator and a heated lambda sensor is disclosed. A value of a sensor voltage is continuously measured. The value of the sensor voltage is compared with a lower diagnostic limit value and an upper diagnostic limit value. A lambda regulator value of the lambda regulator is varied in an enriching direction to a maximum lambda regulation limit if the lower diagnostic limit value fails to be attained, and the lambda regulator value is varied in a leaning down direction to a minimum lambda regulation limit if the upper diagnostic limit value is exceeded. The heating output of the sensor heater is raised after a time period has elapsed during which there is no departure from the maximum lambda regulation limit, and the heating output of the sensor heater is lowered after a time period has elapsed during which there is no departure from the minimum lambda regulation limit. A conclusion is drawn that there is a permanently lean mixture formation error if the lower diagnostic limit value for permanently lean mixtures is exceeded again, and a conclusion is drawn that there is a permanently rich mixture formation error if the upper diagnostic limit value fails to be attained again. Otherwise a sensor error is detected.

4 Claims, 2 Drawing Sheets

METHOD FOR DISTINGUISHING CAUSES OF ERROR IN THE MIXTURE FORMING OR MIXTURE REGULATING SYSTEM OF AN INTERNAL COMBUSTION ENGINE

BACKGROUND OF THE INVENTION

FIELD OF THE INVENTION

The invention relates to a method for distinguishing causes of error in the mixture forming or mixture regulating system of an internal combustion engine, in which a fuel-air mixture supplied to the engine is regulated to a set-point or command value on the basis of an output signal of a heated lambda sensor, with the aid of a lambda regulator and the lambda sensor disposed in an exhaust system of the engine.

In order to keep the proportions of pollutants in the exhaust gas in an internal combustion engine low, it is important to keep the air-fuel ratio of the mixture supplied to the engine at an optimal, previously set value. In order to do so, regulating devices are used that work as a function of a signal furnished by an exhaust gas sensor which is disposed in the engine exhaust system and is known as a lambda sensor. That signal is compared with a reference voltage corresponding to an optimal value, and a control signal for varying the fuel-air delivery is derived from the comparison.

The prerequisite for proper functioning of such a regulating device is that the lambda sensor function perfectly. In the known lambda sensors, which ascertain the oxygen concentration in the exhaust gas, functional readiness is not assured until a certain temperature is reached. In order for the lambda sensor to reach its operating temperature as fast as possible, and so that the sensor temperature can thereafter be kept at a predetermined constant value, an additional heater is provided, which not only assures that the lambda sensor will be heated by the exhaust gases themselves but also assures rapid operational readiness.

The lambda sensors used in such devices are constructed in such a way that at a rich air-fuel mixture, they output a relatively high voltage, and at a lean air-fuel mixture they output a low voltage as compared with a rich mixture composition. The transition from the high to the low voltage is virtually abrupt at the air number lambda =1, because at air numbers that are slightly greater, uncombusted oxygen is suddenly present in the exhaust gas.

On one hand, if the mixture is lean (lambda >1), the voltage output by the lambda sensor is thus near zero (a few mV, for instance) and cannot be distinguished, or can only be distinguished with difficulty, from a break in the supply wires to the lambda sensor (referred to below as a line break) or from a short circuit of the signal line to ground. On the other hand, however, since the output voltage of the lambda sensor is relatively high with a rich mixture (lambda <1), and since even in a short circuit of the lambda sensor line toward the on-board electrical voltage or toward the supply voltage of the electronic control unit the output voltage can assume values that are above a limit value for the rich mixture and therefore can incorrectly indicate that a rich mixture is present, it is again necessary to find out what type of error is involved.

SUMMARY OF THE INVENTION

It is accordingly an object of the invention to provide a method for distinguishing causes of error in the mixture forming or mixture regulating system of an internal combustion engine, which overcomes the hereinafore-mentioned disadvantages of the heretofore-known methods of this general type and which enables a distinction to be made in a simple way between a mixture formation error and a defective, heated lambda sensor.

With the foregoing and other objects in view there is provided, in accordance with the invention, in a method for distinguishing sources of error in a mixture formation or mixture regulating system of an internal combustion engine having an exhaust system with a lambda regulator and a heated lambda sensor, which includes regulating a fuel-air mixture supplied to the engine to a set-point value on the basis of an output signal of the lambda sensor, the improvement which comprises continuously measuring a value of a sensor voltage; comparing the value of the sensor voltage with a lower diagnostic limit value and an upper diagnostic limit value; varying a lambda regulator value of the lambda regulator in an enriching direction to a maximum lambda regulation limit if the lower diagnostic limit value fails to be attained, and varying the lambda regulator value in a leaning down direction to a minimum lambda regulation limit if the upper diagnostic limit value is exceeded; raising the heating output of the sensor heater after a time period has elapsed during which there is no departure from the maximum lambda regulation limit, and lowering the heating output of the sensor heater after a time period has elapsed during which there is no departure from the minimum lambda regulation limit; drawing a conclusion that there is a permanently lean mixture formation error if the lower diagnostic limit value for permanently lean mixtures is exceeded again, and drawing a conclusion that there is a permanently rich mixture formation error if the upper diagnostic limit value fails to be attained again; and otherwise detecting a sensor error.

In accordance with another mode of the invention, there is provided a method which comprises waiting a period of time after variation of the heating output and thereupon initializing a counter, and drawing a conclusion about the type of error involved when a maximum value for the counter is attained.

In accordance with a further mode of the invention, there is provided a method which comprises raising the heating output of the sensor heater to the highest possible value if the sensor voltage drops below the diagnostic limit value.

In accordance with a concomitant mode of the invention, there is provided a method which comprises turning off the sensor heating if the sensor voltage exceeds the diagnostic limit value.

By utilizing the sensor heater, which is already present and assures a constant operating temperature of the lambda sensor, and by means of a certain configuration of successive interrogations, it is possible to detect the actual type of error that is present and to enable storage in memory of only that error in a diagnostic memory or error memory.

False diagnoses of the kind discussed at the outset can be precluded in this way, and replacement of a lambda sensor that was merely suspected to be defective, which is superfluous because it is unnecessary, can be averted as much as possible. Other features which are considered as characteristic for the invention are set forth in the appended claims.

Although the invention is illustrated and described herein as embodied in a method for distinguishing causes of error in the mixture forming or mixture regulating system of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
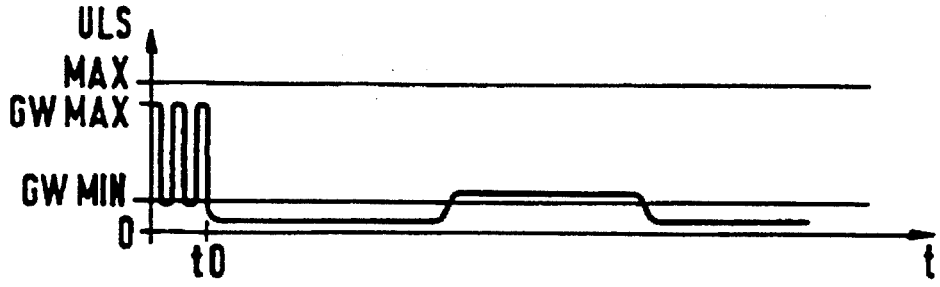
FIGS. 1*a*–1*d* are diagrams showing signal courses during a "permanently lean mixture error" diagnosis.

Referring now in detail to the figures of the drawing, it is noted that a prerequisite for carrying out this method for distinguishing among sources of trouble or error in a mixture formation or mixture regulating system is that a lambda regulation be active, the lambda sensor be ready for operation, and the lambda sensor heater not be defective. Therefore, the sensor heater is checked upon the first start and upon each subsequent start. If the interrogation is negative, or in other words if the sensor heater is not functionally ready, the driver can be informed of this, for instance by a signal light. He or she can then take appropriate provisions for restoring the functional readiness of the sensor heater, and the method described has not yet even begun at all.

Figure 2A:
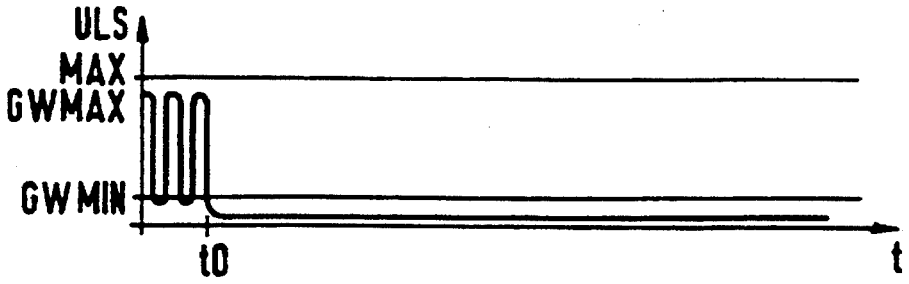
FIGS. 2*a*–2*d* are diagrams showing signal courses during a diagnosis of "sensor error" in a lambda sensor.

Otherwise, there is a wait for a certain period of time until the lambda sensor has reached its operating temperature. The input signal of the lambda sensor is measured at predetermined time intervals (such as every 50 ms) and checked by the diagnosis. FIGS. 1*a* and 2*a* each show some (only qualitatively shown) voltage jumps of the lambda sensor output voltage, which is referred to below as the sensor voltage ULS for the sake of simplicity. In these time diagrams, a maximum value MAX, a lower diagnostic limit value GWMIN and an upper diagnostic limit value GWMAX are shown. At a time t0, the sensor voltage ULS drops below the limit value GWMIN and also remains virtually zero. The consequence of this is that the air-fuel mixture is enriched by the lambda regulator.

Figure 1B:
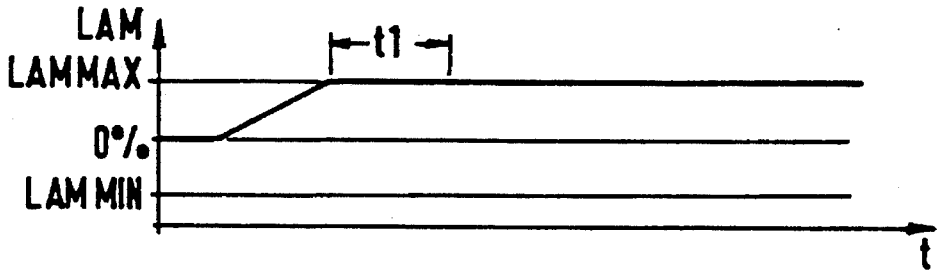
Figure 2B:
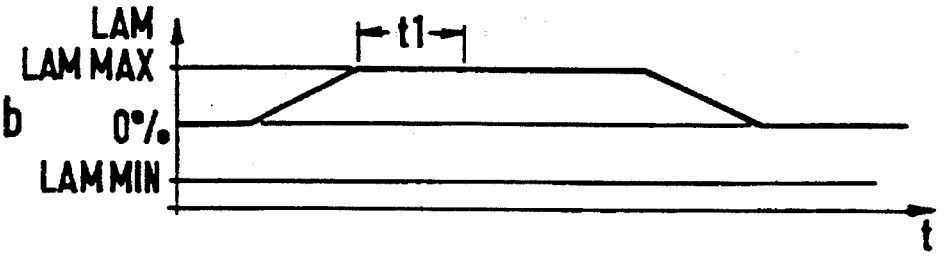

FIGS. 1*b* and 2*b* show this procedure of the lambda regulation. Beginning at a lambda regulator value of LAM=0, an attempt is made to compensate for the control deviation (toward a lean mixture) by raising the lambda regulator value LAM up to a maximum value LAMMAX, which is the so-called regulator stop. Since the sensor voltage continues to be near zero, below the limit value GWMIN, the lambda regulator stays at the regulator stop. A certain dwell time t1 is then waited out, so as to exclude other system errors from the diagnosis.

In typical lambda regulators, the maximum and minimum values are at approximately 25%. In other words, the lambda regulators can enrich up by 25% or lean down by approximately 25%.

After the period t1 has elapsed, the conclusion that an error is present is drawn, and the diagnosis process is initiated in order to determine the type of error.

The lambda sensor heater is used for this purpose. The electric heating of the lambda sensor is performed, in a manner which is known per se, by clocked triggering with a duty factor that is composed of a pilot control value and a lambda sensor voltage regulator value and is stored in a performance graph of the electronic control unit of the engine.

Figure 1C:
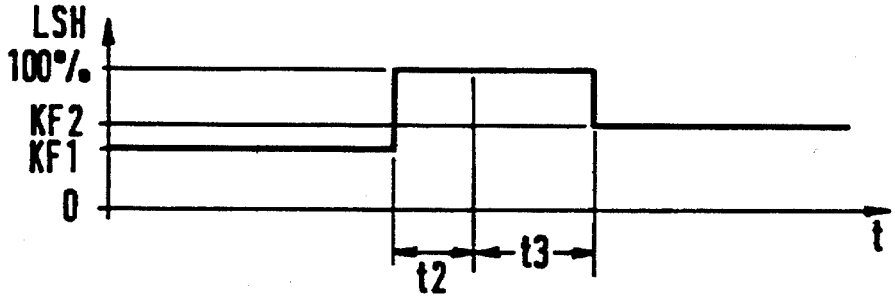
Figure 2C:
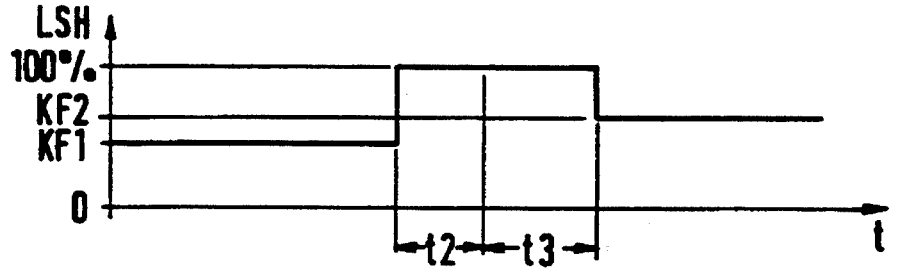
Figure 2D:
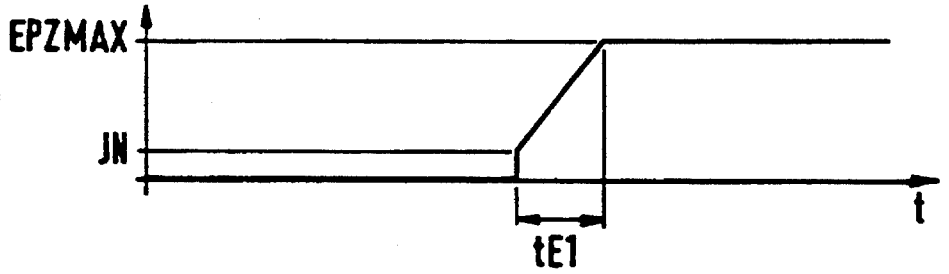

Until the diagnosis begins (after the time period t1 has elapsed), the lambda sensor heater is triggered with a duty factor corresponding to a performance graph value KF1 (FIGS. 1*c*, 2*c*), in order to keep the temperature of the lambda sensor constant at a value that is dependent on engine operating parameters.

Once the dwell time t1 has elapsed, the lambda sensor heater is controlled to 100% of the duty factor and remains at this value for a period of time of t2+t3 (for instance, 5 seconds +6 seconds). This period of time is system-dependent, or in other words is dependent on the sensor structure and on the outside temperature. Since the sensor voltage is highly dependent on the temperature (the sensor voltage rises with increasing temperature) and therefore the voltage that is output in lean operation is also dependent in this way, then if the sensor is intact the sensor voltage ULS must rise again, because of the increased energy input from the heater. From that point on, the preparation then proceeds on to the detection of whether a mixture error or a sensor error is occurring.

Figure 1D:
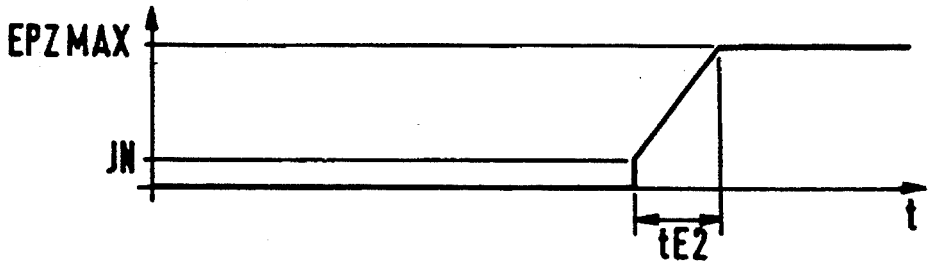

If, after the sensor heating output is increased, the sensor voltage ULS exceeds the lower diagnostic limit value GWMIN, and if, after the heating output is lowered, it drops again to a performance graph value KF2 below the diagnostic limit value GWMIN, then a time counter is thereupon initialized (jump to initializing value JN in FIG. 1*d*). If the counter reaches a value EPZMAX (FIG. 1*d*, time t2), then the "permanently lean" mixture error is detected and is entered in an error memory, for instance. A diagnostic light can also be activated and the necessary provisions for emergency operation can be taken. The lambda regulation remains active. In other words, the lambda regulator remains at the regulator stop LAMMAX (FIG. 1*b*).

A permanently lean mixture error can ensue, for instance if leaking air uncontrollably enters the air intake region of the engine.

Conversely, if the sensor voltage ULS remains below the diagnostic limit value GWMIN (FIG. 2*a*) after the heating output is increased, then after the time period t2 elapses, the detection for lambda sensor error is enabled. At that moment, the counter is again initialized and runs up until it reaches the value EPZMAX (after a time tE1). It is concluded that the type of error is lambda sensor error. In other words, either there is a short circuit of the supply line wires to the lambda sensor toward ground, or the supply lines are broken. This type of error is also stored in an error memory and a diagnosis lamp and emergency operation functions that pertain to this error are activated.

Simultaneously, the lambda regulator value LAM is reset to zero, and the lambda regulator then remains off (FIG. 2*b*).

A corresponding method is employed if the distinction to be made is whether a "permanently rich" mixture error or a sensor error is present. Since in the case of a rich mixture the lambda sensor outputs a relatively high voltage, the upper diagnostic limit value GWMAX is set in order to distinguish the sources of error. If this limit value is exceeded and the lambda regulation proceeds to the regulator limit LAMMIN (FIGS. 1*b*, 2*b*), then the heating for the lambda sensor is turned off, and on the basis of the aforementioned temperature dependency of the sensor voltage a check is then made as to whether or not the voltage has dropped below the upper diagnostic limit value again. Further evaluation is performed as in the method described.

A "permanently rich" mixture error can occur, for instance, if air quantities or air flow rates are incorrectly ascertained, while a sensor error that incorrectly indicates a rich mixture can occur if the supply lines of the sensor have a short circuit toward the supply line to the electronic control unit (typically 5 V) or toward the on-board voltage (12 V).

The method described above can be employed in any internal combustion engines having a lambda regulating device that has a heated lambda sensor, regardless of the type of mixture formation system involved.

We claim:

1. In a method for distinguishing sources of error in a mixture formation or mixture regulating system of an internal combustion engine having an exhaust system with a lambda regulator and a heated lambda sensor, which includes regulating a fuel-air mixture supplied to the engine to a set-point value on the basis of an output signal of the lambda sensor, the improvement which comprises:

continuously measuring a value of a sensor voltage;

comparing the value of the sensor voltage with a lower diagnostic limit value and an upper diagnostic limit value;

varying a lambda regulator value of the lambda regulator in an enriching direction to a maximum lambda regulation limit if the lower diagnostic limit value fails to be attained, and varying the lambda regulator value in a leaning down direction to a minimum lambda regulation limit if the upper diagnostic limit value is exceeded;

raising the heating output of the sensor heater after a time period has elapsed during which there is no departure from the maximum lambda regulation limit, and lowering the heating output of the sensor heater after a time period has elapsed during which there is no departure from the minimum lambda regulation limit;

drawing a conclusion that there is a permanently lean mixture formation error if the lower diagnostic limit value for permanently lean mixtures is exceeded again, and drawing a conclusion that there is a permanently rich mixture formation error if the upper diagnostic limit value fails to be attained again; and otherwise detecting a sensor error.

2. The method according to claim 1, which comprises waiting a period of time after variation of the heating output and thereupon initializing a counter, and drawing a conclusion about the type of error involved when a maximum value for the counter is attained.

3. The method according to claim 1, which comprises raising the heating output of the sensor heater to the highest possible value if the sensor voltage drops below the diagnostic limit value.

4. The method according to claim 1, which comprises turning off the sensor heating if the sensor voltage exceeds the diagnostic limit value.

* * * * *